US012577724B2

(12) United States Patent
Zamarin et al.

(10) Patent No.: US 12,577,724 B2
(45) Date of Patent: Mar. 17, 2026

(54) NONFLUORINATED HYDROPHOBIC WATERBORNE TREATMENTS AND COATINGS

(71) Applicant: DetraPel, Inc., Framingham, MA (US)

(72) Inventors: David Zamarin, Jamison, PA (US); Casey Wetzel, San Diego, CA (US); Juan Jarufe, North Olmstead, OH (US)

(73) Assignee: DETRAPEL, INC., Framingham, MA (US)

( * ) Notice: Subject to any disclaimer, the term of this patent is extended or adjusted under 35 U.S.C. 154(b) by 707 days.

(21) Appl. No.: 17/770,784

(22) PCT Filed: Oct. 22, 2020

(86) PCT No.: PCT/US2020/056854

§ 371 (c)(1),
(2) Date: Apr. 21, 2022

(87) PCT Pub. No.: WO2021/081198

PCT Pub. Date: Apr. 29, 2021

(65) Prior Publication Data

US 2023/0002962 A1 Jan. 5, 2023

Related U.S. Application Data

(60) Provisional application No. 62/924,494, filed on Oct. 22, 2019.

(51) Int. Cl.

| | |
|---|---|
| ***D06M 11/79*** | (2006.01) |
| ***D06M 13/17*** | (2006.01) |
| ***D06M 15/564*** | (2006.01) |
| ***D06M 15/643*** | (2006.01) |
| ***D06M 23/10*** | (2006.01) |
| ***D06M 101/06*** | (2006.01) |
| ***D06M 101/32*** | (2006.01) |

(52) U.S. Cl.
CPC ..... *D06M 11/79* (2013.01); *D06M 13/17* (2013.01); *D06M 15/564* (2013.01); *D06M 15/643* (2013.01); *D06M 23/10* (2013.01); *D06M 2101/06* (2013.01); *D06M 2101/32* (2013.01); *D06M 2200/12* (2013.01)

(58) Field of Classification Search
CPC ..... C01B 33/14; D06M 11/79; D06M 13/17; D06M 15/564; D06M 15/643; D06M 23/10; D06M 2101/06; D06M 2101/32; D06M 2200/12; D06M 13/165; D06M 15/647; D06M 2200/01; D06M 2200/05
See application file for complete search history.

(56) References Cited

U.S. PATENT DOCUMENTS

| | | | |
|---|---|---|---|
| 6,358,914 | B1 | 3/2002 | Gabriel et al. |
| 8,377,193 | B2 | 2/2013 | Lortz et al. |
| 8,425,981 | B1 | 4/2013 | Fan et al. |
| 8,871,926 | B1 | 10/2014 | Fan et al. |
| 8,986,826 | B2 | 3/2015 | Münster et al. |
| 9,040,435 | B2 | 5/2015 | Kissel et al. |
| 9,303,120 | B2 | 4/2016 | Sybert et al. |
| 9,550,621 | B2 | 1/2017 | Smits |
| 9,790,019 | B2 | 10/2017 | Brouwer et al. |
| 9,804,697 | B2 | 10/2017 | Tang et al. |
| 10,087,347 | B2 | 10/2018 | Yamasaki et al. |
| 10,392,536 | B2 | 8/2019 | Bae et al. |
| 10,513,617 | B2 | 12/2019 | Iyer et al. |
| 10,640,641 | B2 | 5/2020 | Ravichandran et al. |
| 10,889,938 | B2 | 1/2021 | Constant et al. |
| 11,987,501 | B2 | 5/2024 | Nguyen et al. |
| 2005/0205830 | A1 | 9/2005 | Oles et al. |
| 2008/0264259 | A1 | 10/2008 | Leung |
| 2009/0064894 | A1 | 3/2009 | Baumgart et al. |
| 2009/0264579 | A1 | 10/2009 | Kitawaki |
| 2010/0099316 | A1 | 4/2010 | Norenberg et al. |
| 2015/0191607 | A1 | 7/2015 | Mcdaniel |
| 2017/0204279 | A1 | 7/2017 | Larimer et al. |

(Continued)

FOREIGN PATENT DOCUMENTS

| | | | |
|---|---|---|---|
| EP | 2107086 | A1 | 10/2009 |
| EP | 3250475 | A1 | 12/2017 |
| KR | 10-771894 | B1 * | 10/2007 |

(Continued)

OTHER PUBLICATIONS

BYK Additives & Instruments, "BYK-11 Data Sheet," Dec. 2013.
BYK Additives & Instruments, "BYK-22 Data Sheet," Oct. 2012.
BYK Additives & Instruments, "BYK-24 Data Sheet," May 2014.
BYK Additives & Instruments "DISPERBYK-190 Data Sheet," Oct. 2012.

(Continued)

*Primary Examiner* — Anthony J Green

(74) *Attorney, Agent, or Firm* — Marco H. Santamaria; Laura J. Ingersol

(57) ABSTRACT

The present invention relates generally to methods of producing, using, and storing stable aqueously dispersed superhydrophobic compositions made from these compositions to provide superhydrophobic treatments on a range of porous, semi-porous, and non-porous target materials and surfaces as well as combinations of these materials and surfaces. More particularly, the present invention provides stably dispersed waterborne superhydrophobic compositions comprising colloidal silica or hydrophobically-modified silicon dioxide (i.e., silica) and one or more additional agents and/or compounds. When the compositions of the present invention are applied (e.g., via spray deposition, immersion, liquid application, and the like) to a suitable target material and/or surface the target is imparted with a durable (super)hydrophobic coating.

16 Claims, 7 Drawing Sheets

(56) References Cited

U.S. PATENT DOCUMENTS

| | | | | |
|---|---|---|---|---|
| 2017/0327301 | A1 | 11/2017 | Kelders | |
| 2019/0091131 | A1* | 3/2019 | Magnet | A61K 8/87 |
| 2022/0105370 | A1 | 4/2022 | Tabbara et al. | |
| 2022/0258938 | A1 | 8/2022 | Sato | |
| 2025/0215637 | A1 | 7/2025 | Zamarin et al. | |

FOREIGN PATENT DOCUMENTS

| | | | |
|---|---|---|---|
| KR | 10-1499352 | B1 * | 3/2015 |
| WO | 2005068400 | A1 | 7/2005 |
| WO | WO-2015058344 | A1 * | 4/2015 |
| WO | 2019/144910 | | 8/2019 |
| WO | 2021081198 | A1 | 4/2021 |
| WO | 2024187026 | A2 | 9/2024 |

OTHER PUBLICATIONS

BYK Additives & Instruments, "OPTIGEL-LX Data Sheet," Nov. 2016.

BYK Additives & Instruments, "RHEOBYK-H 6500 VF Data Sheet," Dec. 2018.

BYK Additives & Instruments, "RHEOBYK-L 1400 VF Data Sheet," Dec. 2018.

Evonik, "DYNOL 60 Data Sheet" Mar. 15, 2019.

International Search Report and Written Opinion of the International Searching Authority, malled Jan. 25, 2021, in parent PCT/US2020/056854.

Atrie, Damon , et al., "Surgical mask versus N95 respirator for preventing influenza among health care workers: a randomized trial", CJEM, vol. 14, No. 1, 2012, 50-52.

Baig, Aliya S., et al., "Health care workers' views about respirator use and features that should be included in the next generation of respirators", Am J Infect Control, vol. 38, 2010, 18-25.

Eck, E. K., et al., "The effect of high-efficiency particulate air respirator design on occupational health: a pilot study balancing risks in the real world", Infection Control and Hospital Epidemiology, vol. 18, No. 2, 1997, 122-127.

Lau, Joseph T.F., et al., "SARS Transmission among Hospital Workers in Hong Kong", Emerging Infectious Diseases, vol. 10, No. 2, 2004, 280-286.

Lu, Yen-Ta T.F., et al., "Viral Load and Outcome in SARS Infection: the Role of Personal Protective Equipment in the Emergency Department", The Journal of Emergency Medicine, vol. 30, No. 1, 2006, 7-15.

Lustig, Steven R., et al., "Effectiveness of Common Fabrics to Block Aqueous Aerosols of Virus-like Nanoparticles", ACS Nano, vol. 14, 2020, 7651-7658.

Moore, David M., et al., "Occupational health and infection control practices related to severe acute respiratory syndrome: health care worker perceptions", Journal of the American Association of Occupational Health Nurses, vol. 53, No. 6, 2005, 257-266.

Nishiyama, Ayako T.F., et al., "Risk factors for SARS infection within hospitals in Hanoi, Vietnam", Jpn J Infect Dis., vol. 61, No. 5, 2008, 388-390.

Radonovich, Lewis J., et al., "Respirator Tolerance in Health Care Workers", JAMA, vol. 301, No. 1, 2009, 36-38.

Yen, M. Y., et al., "Using an integrated infection control strategy during outbreak control to minimize nosocomial infection of severe acute respiratory syndrome among healthcare workers", Journal of Hospital Infection, vol. 62, No. 2, 2006, 195-199.

Gong, et al., "Highly durable superhydrophobic polydimethylsiloxane/silica nanocomposite surfaces with good self-cleaning ability", ACS Omega, vol. 5, No. 8, Feb. 19, 2020, 4100-4108.

* cited by examiner

Contact Angle Decreases over 30 Seconds

Contact Angle Decreases over 30 Seconds

Average Contact Angle Across Different Fabrics

Average Contact Angle Decreases Across Different Fabrics

NONFLUORINATED HYDROPHOBIC WATERBORNE TREATMENTS AND COATINGS

CROSS-REFERENCE TO RELATED APPLICATION

This application claims the benefit of U.S. Provisional Patent Application No. 62/924,494, filed Oct. 22, 2019, which is incorporated by reference herein in its entirety.

FIELD OF THE INVENTION

The present invention relates generally to methods of producing, using, and storing stable aqueously dispersed superhydrophobic compositions made from these compositions to provide superhydrophobic treatments on a range of porous, semi-porous, and non-porous target materials and surfaces as well as combinations of these materials and surfaces. More particularly, the present invention provides stably dispersed waterborne superhydrophobic compositions comprising colloidal silica or hydrophobically-modified silicon dioxide silica) and one or more additional agents and/or compounds. When the compositions of the present invention are applied (e.g., via spray deposition, immersion, liquid application, and the like) to a suitable target material and/or surface the target is imparted with a durable (super) hydrophobic coating.

BACKGROUND OF THE INVENTION

A superhydrophobic surface is a highly water-repellent surface characterized by a resistance to wetting and high-water droplet contact angles. Surfaces with water droplet contact angles more than 90° are generally considered to be hydrophobic. On a smooth surface, a water droplet can theoretically reach a maximum contact angle of 120°. If the apparent water droplet contact angle exceeds 150°, as may occur when a surface includes microscale asperities, the surface may be said to be superhydrophobic. Superhydrophobicity is sometimes referred to as the "lotus leaf effect" given its observance in nature.

The surface of a lotus leaf is covered with countless microscopic protrusions coated with a waxy layer. This waxy layer acts as a multifunctional interface between the leaf and its environment, influencing airflow, air pocket formation, and light reflection, and imparting, along with the protrusions, very high-water repellency to the surface of the leaf. Water falling on the leaf beads into a near-spherical shape known as the "Cassie-Baxter state", and subsequently rolls over and off the surface as small droplets. The hydrophobic topographical micro-features minimize the area of contact between a water droplet and the leaf surface, thereby keeping the droplet in contact mainly with the surrounding air. As a result, the water on the leaf surface substantially retains the droplet shape it would have in the air. The rough, waxy microstructures present on the lotus leaf result in contact angles as high as 170°, thereby imparting to the surface enhanced superhydrophobic properties.

Surfaces may be roughened, patterned, or otherwise processed to obtain the microscale features deemed advantageous for superhydrophobicity. Superhydrophobic coatings may also be formed on a hydrophilic surface to impart superhydrophobic characteristics to the surface. Challenges remain, however, in producing stable aqueously dispersed superhydrophobic compositions and formulations and in effectively depositing these coatings on substrates and target surfaces.

Those skilled in the art will be able to measure various characteristics of deposited superhydrophobic coatings on a surface using any number of known techniques and apparatuses. Suitable techniques and apparatus for making these measurements are known in the art. For example, the morphology and/or topography of the deposited coatings can be characterized using techniques such as Scanning Electron Microscopy (SEM) and Transmission Electron Microscopy (TEM).

Additionally, techniques such as Atomic Force Microscopy (AFM) can be used to measure the surface roughness of the deposited coatings. The contact angle, roll-off angle, and contact angle hysteresis of deionized water droplets on coated surfaces can be measured at random locations using a contact angle goniometer such as an OCA 20 (Data Physics Corp., San Jose, Calif.) when equipped with a charge-coupled device (CCD) camera and suitable image processing software with average, minimum, and maximum values being obtained.

The mechanical durability of the various superhydrophobic coating embodiments can be evaluated using, for example, the dry pencil hardness test, dry and wet tape adhesion tests, and by using a liner abrasion testing device (e.g., Taber Linear Abraser 5750) (Taber Industries, North Tonawanda, NY). In more detail, the pencil hardness test method comprises using a pencil with a quantified hardness being dragged across the test surface at a specified angle, generally at 45°, and a specified pressure as it is moved along the surface in a mechanical carriage at constant speed. The maximum pencil hardness that the surface can withstand before the pencil leaves a permanent mark is associated with its mechanical durability. The pencil hardness scale ranges from 10B (softest) to 10H (hardest). A testing scale of from 6B to 9H is generally used. In preferred embodiments, the pencil hardness test results in substantially no visible wear or scratch marks while the coating remains substantially superhydrophobic (i.e., contact angle remains about 150° or greater).

Tape peeling tests, preferably according to ASTM D3359 Method B46, can be used to test overall adhesion to the substrate and cohesive adhesion for coatings. Tape removal testing on superhydrophobic surfaces can lead to partial destruction of the micro/nano-scale topography of the surface and loss of superhydrophobicity. Tapes are classified according to the values of adhesion force to a reference substrate, reported as adhesion to steel expressed in N/m. As this parameter (force/distance) increases, the tape peeling test becomes more destructive to the coating under investigation and the results can lead to valuable conclusions about coating durability and loss of superhydrophobicity.

Superhydrophobicity is known to be linked to the surface topography of the surface and several useful models have been designed to take surface aspects into consideration. Roughness is a useful indicator of the probability for a given surface to be superhydrophobic, it is however in practice sometimes difficult to determine the superhydrophobic character of a coating based on surface aspects alone. Thus, in still other embodiments it advantageous to evaluate superhydrophobicity based on the receding static water contact angle and water sliding angle and stability of these properties. Moreover, the SuperHydrophobic Index which provides an indication of the percentage of surface area which is actually superhydrophobic is also an important aspect in considering the superhydrophobic property of a surface.

BRIEF DESCRIPTION OF THE DRAWINGS

In the drawings, some embodiments are illustrated by way of example, and not limitation, in the figures of the accompanying drawings in which.

SUMMARY OF THE INVENTION

Figure 1A:
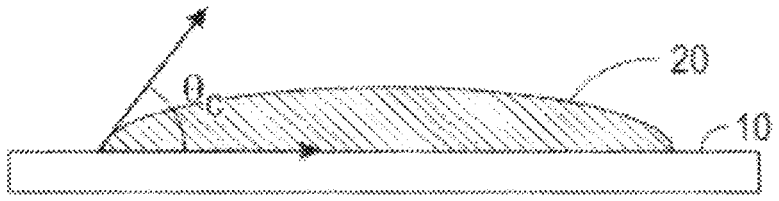
FIGS. 1A-1C illustrate the concept of contact angles on hydrophilic, hydrophobic, and superhydrophobic surfaces.

The present invention relates generally to methods of producing, using, and storing stable aqueously dispersed superhydrophobic compositions made from these compositions to provide superhydrophobic treatments on a range of porous, semi-porous, and non-porous target materials and surfaces as well as combinations of these materials and surfaces. More particularly, the present invention provides stably dispersed waterborne superhydrophobic compositions comprising colloidal silica or hydrophobically-modified silicon dioxide (i.e., silica) and one or more additional agents and/or compounds. When the compositions of the present invention are applied (e.g., via spray deposition, immersion, liquid application, and the like) to a suitable target material and/or surface the target is imparted with a durable (super)hydrophobic coating.

The compositions, exemplary product formulations, and the like, described herein form stable aqueous solutions, suspensions, emulsions and the like. As such, the compositions comprise at least 25% water, and preferably closer to 50% water.

In preferred embodiments, the compositions are optimized for application to a range of fabric and/or textile based products used in a range of settings and applications, such as, building materials and industrial products (e.g., sun screens, awnings, coverings, tarps, etc.), uniforms (e.g., service industries, military, law enforcement, first responders, etc.), consumer products (e.g., clothes, blankets, tents, tarps, bulk fabrics and textiles, etc.) and shoes and articles of clothing, among other items and products. In some embodiments, suitable textiles and fabrics for treatment with the compositions are preferably manufactured or processed using techniques known in the art including, but not limited to, knitting, knotting, crocheting, pressing, weaving, and the like. Suitable textiles and fabrics may further comprise one or more types of fibers or constituents comprising natural materials (e.g., cotton, flax, fur, leather, hair, hemp, silk, wool, and the like), manmade materials (e.g., Acetate, Acrylic/Polyacrylic, Cupro, Elastane, Lyocell/Tencel, Modal, organza, Polyamide/Nylon, Polyester, Rayon, Spandex, Viscose, and the like), and combinations and blends thereof (e.g., Chiffon).

Preferred embodiments of the present invention provide compositions useful for producing a superomniphobic (e.g., one or more characteristics of hydrophobicity, superhydrophobicity, oleophobicity, resisting soiling, resisting fouling, resisting staining, and/or resisting fogging) and like characteristics surface. Various compositions of the present invention are optimized for treating or contacting textile and/or fabric substrates used in articles of clothing or other consumer type products designed to be worn or come into contact with a user's skin, preferably, in these embodiments the composition do not substantially alter the softness, color, durability, or breathability, and the like, of the textile or fabric substrate. It is further intended that articles of clothing treated with the compositions described herein will be at least as easy to clean and care for as the same, or similar, articles that have not been treated with the compositions.

Additional preferred embodiments of the instant compositions and methods provide superhydrophobic compositions that are substantially transparent when applied and that are strongly bonded to the underlying target surface or substrate (e.g., textile and/or fabric). If desired, the substrate may be cleansed or otherwise primed to optimize contact of the liquid solution and adherence of the resulting superhydrophobic coating.

The superhydrophobic compositions described herein are generally non-flammable and non-volatile and environmentally safe. The compositions can also be prepared by simple means and are also highly amenable for deposition by a variety of means (e.g., spraying or dipping) onto any of a variety of substrates to render them superhydrophobic. More particularly, the compositions can be deposited by any of the known deposition techniques, such as, but not limited to, spray-coating, dip-coating, or spin-coating, and the like.

Methods are provided wherein liquid compositions are deposited onto a substrate to form a coated substrate, optionally, followed by subjecting the coated substrate to a drying step to remove the liquid phase of the composition, wherein the composition comprises hydrophobically-treated particles (e.g., functionalized fumed silica) and/or hydrophobic silica (e.g., (untreated fumed silica and/or colloidal silica), an aqueous carrier, and one or more additional modifying agents and/or compounds. In certain of these methods, the aqueous compositions described herein are deposited onto the target surface or intended substrate, followed by exposing the coated substrate to a drying step. In certain embodiments, where a drying step is employed as part of the deposition method, the drying step is practiced by, for example, air drying under ambient conditions, direct heating of the target surface, heating a gas (e.g., air) in contact with the target surface, or more generally, by exposing the target surface to one or more suitable electromagnetic energies. Generally, drying can be enhanced by any method that increases the rate of evaporation of the aqueous component of the composition while maintain the desired superhydrophobic characteristics of the composition following deposition. Where employed, the heating step is generally accomplished at a temperature below the decomposition temperature of the coating solution for sufficient time. For example, in some embodiments, the drying step may employ a temperature of, for example, about 20, 25, 30, 40, 50, 60, 70, 80, 90, 100, 110, 120, 130, 140, 150, 160, 170, 180, 190, 200, 300, 400, 450, 500° C., or more, (or within a range bounded by any two of the foregoing values) for a period of time of at least 1, 5, 10, 20, 30, 40, 50, 60, 90, or 120 minutes (or within a range bounded by any two of the foregoing values or within the values).

The superhydrophobic coating of the present invention are contemplated to find use in protecting the underlying substrate (e.g., woven and nonwoven fabrics) from adverse effects caused by contact with any of a variety of liquids, such as aqueous, hydrophilic organic, or hydrophobic organic solvents. More particularly, the substrate may be, for example, a polymer, fabric, or textile. In preferred embodiments, the substrate comprises a fabric or textile. In particularly preferred embodiments, the substrate comprises a fabric or textile.

The resulting coatings are superhydrophobic and preferably strongly adhered to the substrate and optically transparent. The thickness of the superhydrophobic coatings can vary depending on the method of deposition and formulation of the coating. The thickness is typically at least 10 nm (0.01 microns). In different embodiments, the coating may have a thickness of precisely, about, up to, less than, at least, or above, for example, 1 nm, 10 nm, 20 nm, 50 nm, 100 nm, 250 nm, 500 nm, 1000 nm (1 μm), 2 μm, or 5 μm, 10 μm, 50 μm, 100 μm, 150 μm, 200 μm, 250 μm, 300 μm, 350 μm, 400 μm, 500 μm, or 1000 μm (1 mm), 10 nm to 500 nm, or a thickness within a range bounded by any two of these values or within the values.

In some embodiments, the present invention provides compositions and methods for coating a substrate, wherein the method comprises depositing a single layer of the composition on the substrate. In other embodiments, the present invention provides compositions and methods for coating a substrate, wherein the method comprises depositing more than one layer of the composition on a substrate (e.g., a first, and second layer; a first, and second, and third layer, . . . etc.). In embodiments, where more than one layer is deposited, the several coated layers may be the same formulation or one or more different formulations of the present compositions. Where multiple layers of the composition(s) are deposited on a surface, the layers can be of uniform thickness or varying thicknesses. The thickness of the one layer, or various layers, of the inventive coatings can vary according to the demands and needs of a given application.

The compositions are preferably prepared without any fluorine containing components (e.g., perfluoroalkyl substances). Accordingly, in some preferred embodiments, the compositions comprise stable aqueously dispersed treatments comprising hydrophobically-treated particles (e.g., functionalized fumed silica) and/or hydrophobic silica (e.g., (untreated fumed silica and/or colloidal silica) and one or more additional components (agents) with the proviso that said composition comprise substantially no fluorine containing components therein. In still other embodiments, the compositions comprise stable aqueously dispersed treatments comprising hydrophobically-modified silica and one or more additional components with the proviso that there are no fluorine containing components therein. While the present invention is not limited to any particular formulation(s), favored compositions provide environmentally safe non-fluorine containing (super)hydrophobic treatments.

Definitions

Figure 1B:
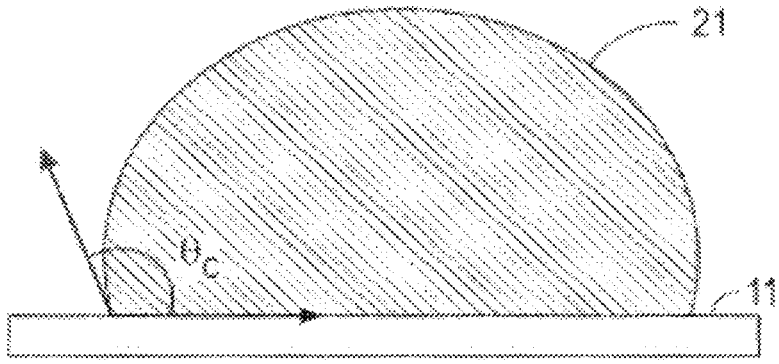
Figure 1C:
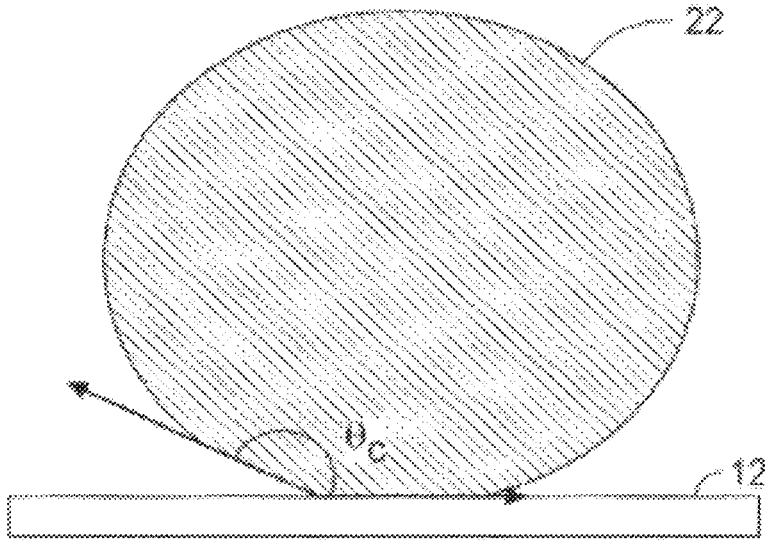
Figure 2:
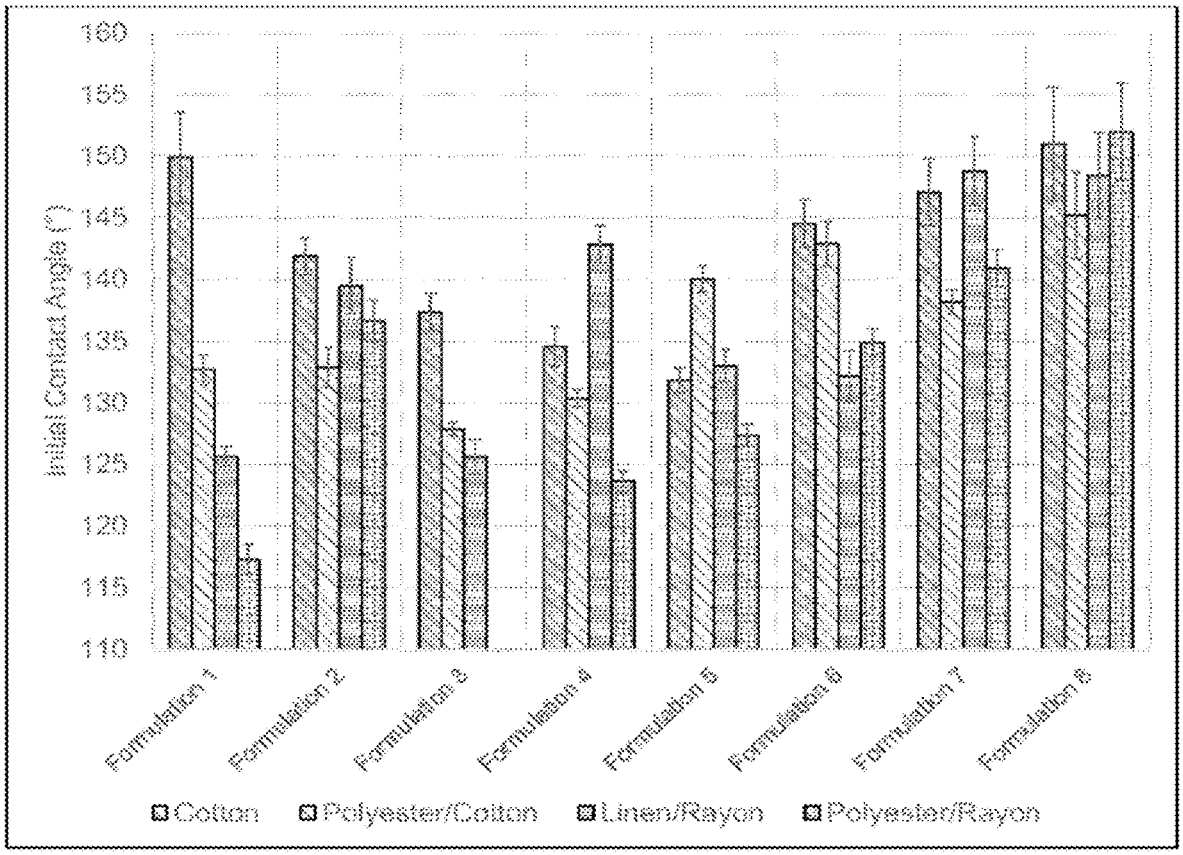
FIG. 2 shows the initial contact angles of a 10 μL water droplet achieved with various Exemplary Product Formulations.
Figure 3:
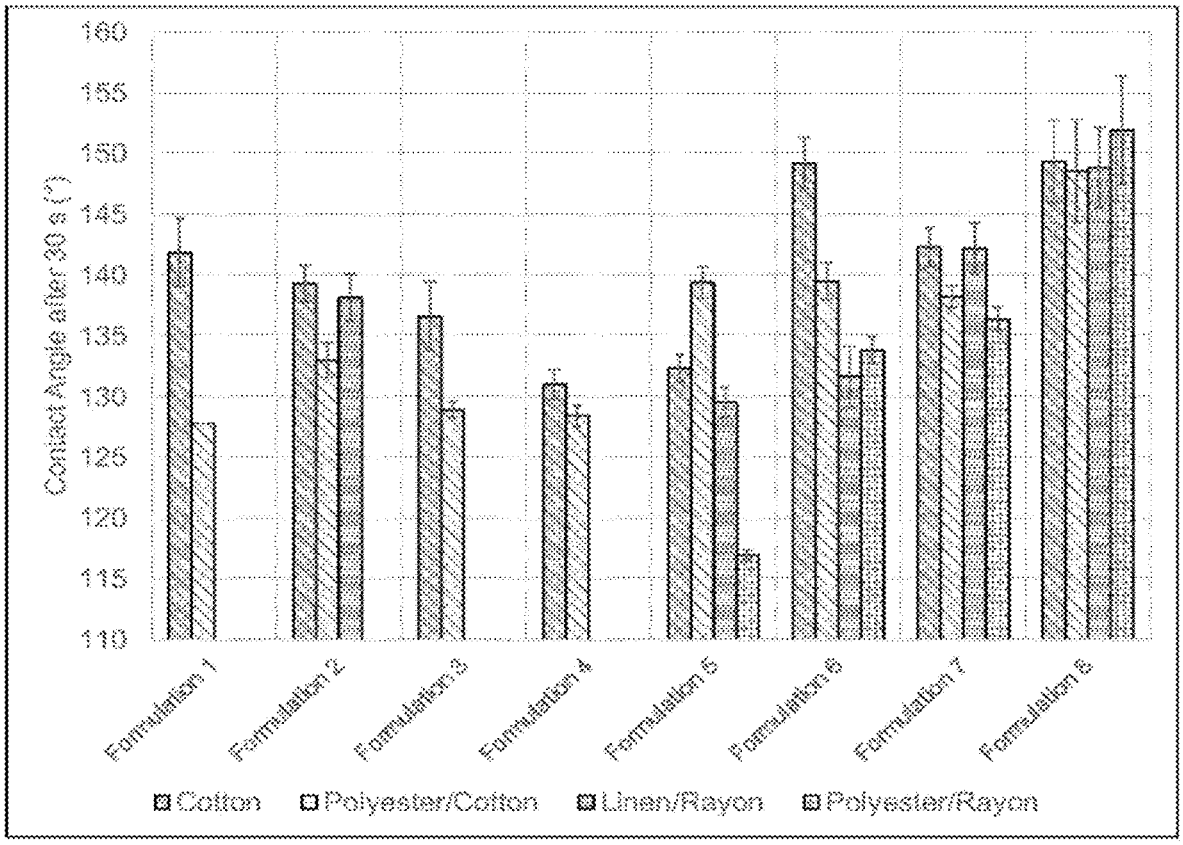
FIG. 3 shows contact angles of a 10 μL water droplet achieved after 30 seconds with Exemplary Product Formulations.
Figure 4:
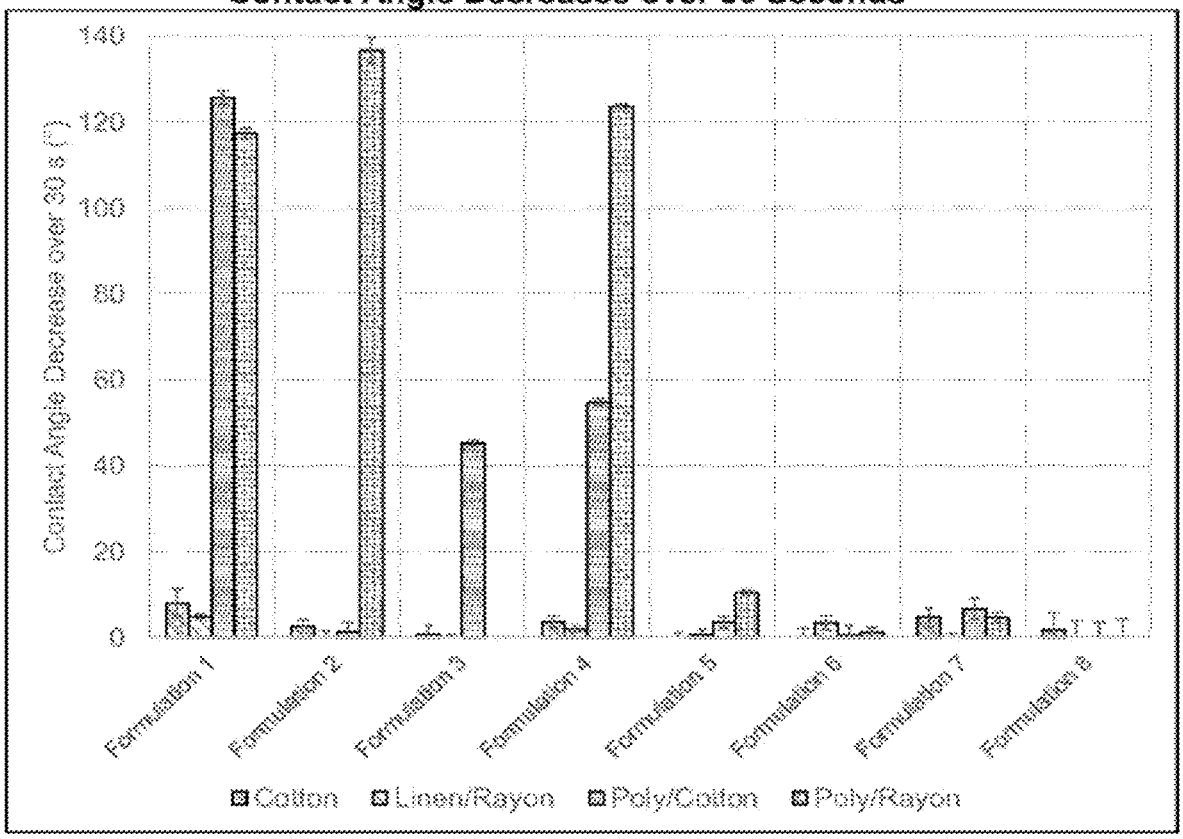
FIG. 4 shows decreases in contact angles of a 10 μL water droplet after 30 seconds with Exemplary Product Formulations. Higher bars indicate water absorbency of the treated fabric.
Figure 5:
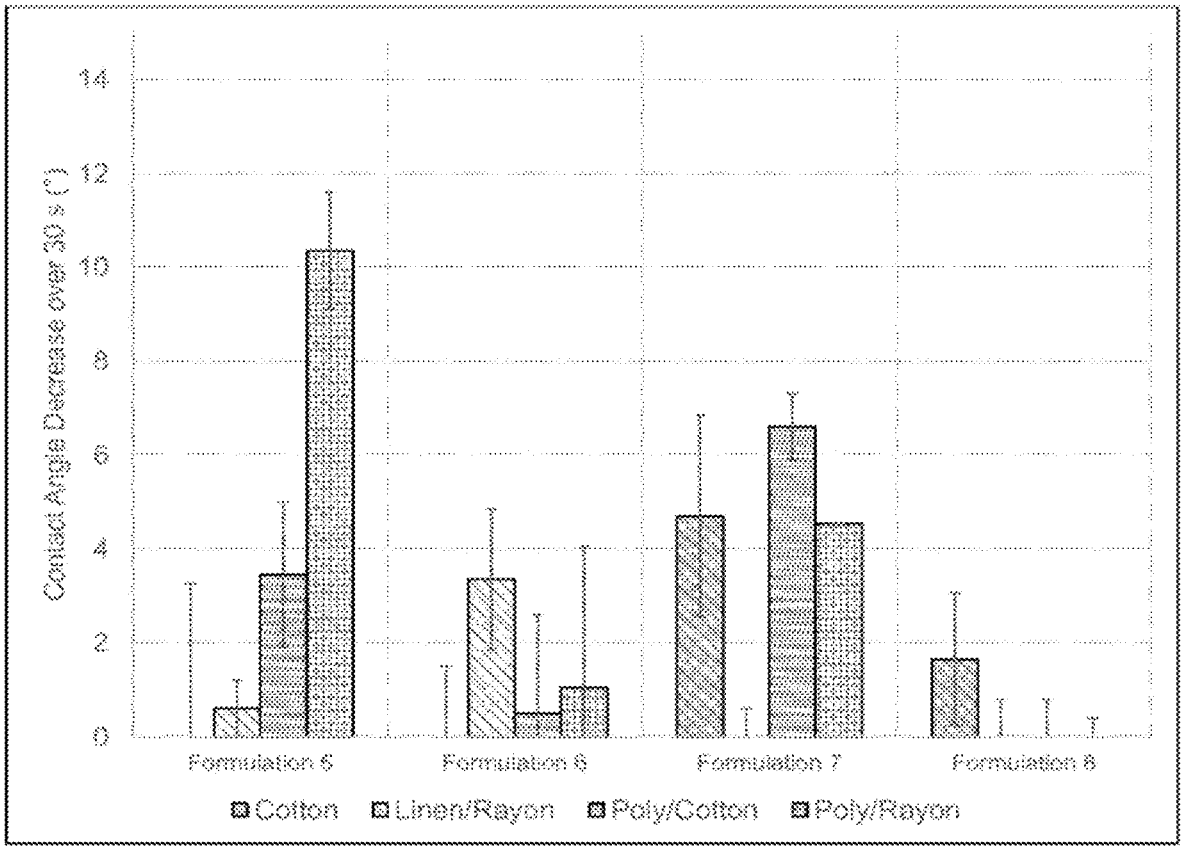
FIG. 5 shows decreases in contact angle of a 10 μL water droplet after 30 seconds with Exemplary Product Formulations. Higher bars indicate water absorbency of the treated fabric.
Figure 6:
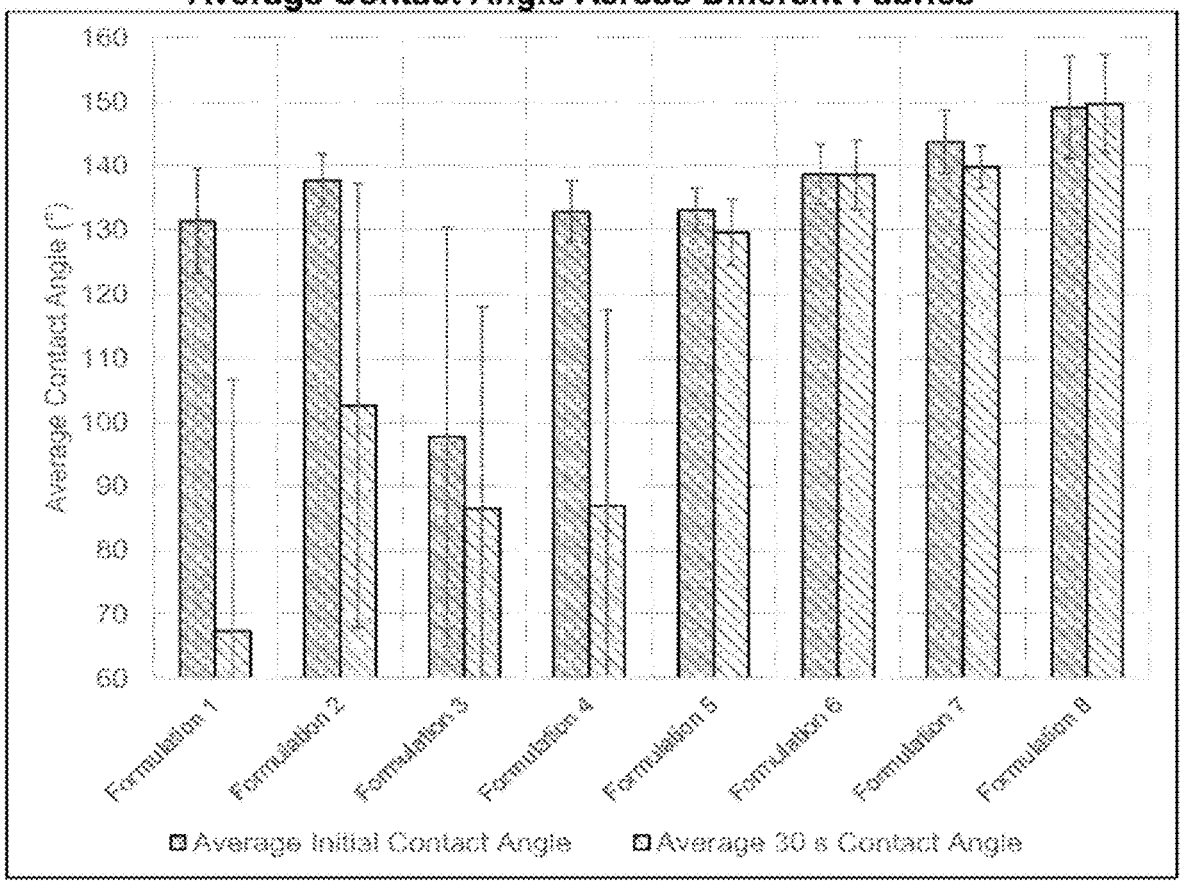
FIG. 6 shows average contact angles across different fabric substrate types contacted with Exemplary Product Formulations.
Figure 7:
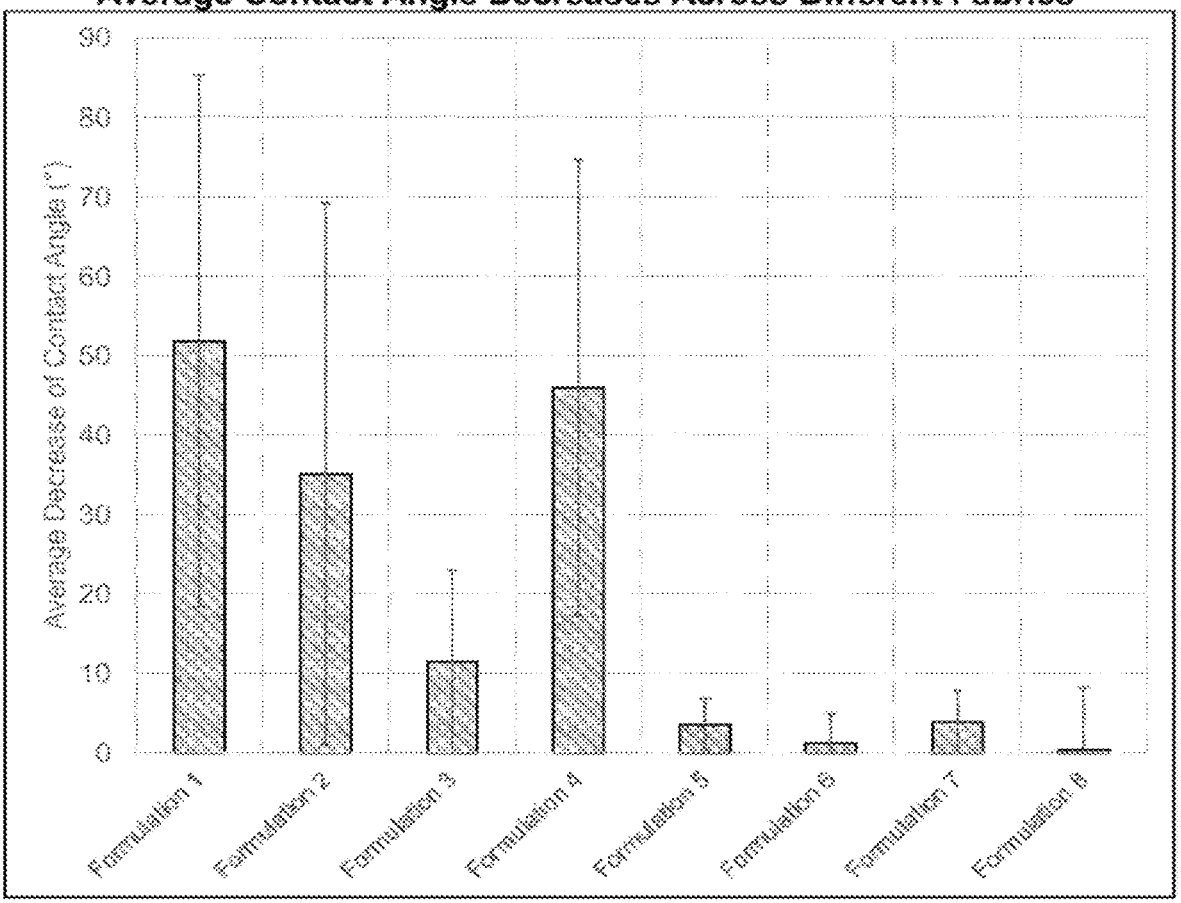
FIG. 7 shows average decreases in contact angle of a 10 μL water droplet after 30 seconds across different fabric substrate types contacted with Exemplary Product Formulations. Higher bars indicate water absorbency of the treated fabric.

As used herein, the term "hydrophilic surface" is defined as a surface that produces a contact angle of less than 90° with a droplet of water. The term "hydrophobic surface" is defined as a surface that produces a contact angle of at least 90° but no greater than 150° with a droplet of water. And the term "superhydrophobic" is defined as a surface (i.e., coated with the instant superhydrophobic compositions and formulations) that produces a contact angle of more than 150° with a droplet of water. A "contact angle" ($\theta_c$) is the angle where a liquid-vapor surface meets a solid surface and it quantifies the wettability of a solid surface by the liquid. FIGS. 1A-1C illustrate the concepts of contact angles on hydrophilic, hydrophobic, and superhydrophobic surfaces. In each of FIGS. 1A-1C, a water droplet rests on a surface and exhibits a different "contact angle." In FIG. 1A, surface 10 is a hydrophilic surface and produces a contact angle 9, with water droplet 20 that is less than 90°. In FIG. 1B, surface 11 is a hydrophobic surface and produces a contact angle 8, with water droplet 21 that is greater than or equal to 90° but less than or equal to 150°. In FIG. 1C, surface 12 is said to be a superhydrophobic surface (i.e., coated with the instant superhydrophobic compositions and formulations) and thusly produces a contact angle 9, with water droplet 22 that is greater than 150'.

As used herein, the term "nanoparticles" refers to particles having a size of between 1 and 100 nanometers, and more preferably, from between 10 nm to 50 nm.

The term "about" or "approximately" means within an acceptable error range for the particular value as determined by one of ordinary skill in the art, which will depend in part on how the value is measured or determined, i.e., the limitations of the measurement system. For example, "about" can mean within 1 or more than 1 standard deviation, per the practice in the art.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended; that is, a composition, article, or process that includes elements in addition to those listed after such a term in a claim are still deemed to fall within the scope of that claim. Moreover, in the following claims, the terms "first," "second," and "third," and so forth are used merely as labels, and are not intended to impose numerical requirements on their objects.

Recitation of ranges of values herein are merely intended to serve as a shorthand method of referring individually to each separate value falling within the range, unless otherwise indicated herein, and each separate value within the range is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Unless otherwise defined herein, technical terms used in connection with the present invention shall have the meanings that are commonly understood by those of ordinary skill in the art. The meaning and scope of the terms should be clear, however, in the event of any latent ambiguity, definitions provided herein take precedent over any dictionary or extrinsic definition. In this application, the use of "or" means "and/or" unless stated otherwise.

Where a percentage is provided with respect to an amount of a component, agent, or material in a particular composition or formulation, the percentage should be understood to be a percentage based on weight, unless otherwise stated or understood from the context.

Where a molecular weight is provided and not an absolute value, for example, of a component, agent, or material in a particular composition or formulation, the molecular weight should be understood to be an average molecule weight, unless otherwise stated or understood from the context.

The order of steps or order for performing certain actions is immaterial so long as the present teachings remain operable. Moreover, two or more steps or actions may be conducted simultaneously.

At various places in the present specification, numerical values are disclosed in groups or in ranges. It is specifically intended that the description include each individual subcombination of the members of such groups and ranges and any combination of the various endpoints of such groups or ranges. For example, an integer in the range of 0 to 40 is specifically intended to individually disclose 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, and 40, and an integer in the range of 1 to 20 is specifically intended to individually disclose 1, 2, 3, 4, 5, 6, 7, 8, 9, 10, 11, 12, 13, 14, 15, 16, 17, 18, 19, and 20.

DESCRIPTION OF THE INVENTION

The present invention relates generally to methods of producing, using, and storing stable aqueously dispersed superhydrophobic compositions made from these compositions to provide superhydrophobic treatments on a range of porous, semi-porous, and non-porous target materials and surfaces as well as combinations of these materials and surfaces. More particularly, the present invention provides stably dispersed waterborne superhydrophobic compositions comprising colloidal silica or hydrophobically-modified silicon dioxide (i.e., silica) and one or more additional agents and/or compounds. In still other embodiments, the compositions comprise hydrophobically-treated particles (e.g., functionalized fumed silica) and/or hydrophobic silica (e.g., untreated fumed silica and/or colloidal silica) and one or more additional agents and/or compounds. When the compositions of the present invention are applied (e.g., via spray deposition, immersion, liquid application, and the like) to a suitable target material and/or surface the target is imparted with a durable (super)hydrophobic coating.

The colloidal silica or fumed is dispersed in water such that the hydrophobic qualities of the surface-modified silica are largely maintained. In some preferred embodiments, the hydrophobic qualities of the surface-modified silica are maintained by inclusion of one or more additives that provide or augment the desired chemical, physiochemical, rheological, etc., properties of the formulation. For example, in some embodiments, comprise one or more additives including dispersants, defoamers, rheology-modifying agents (e.g., thickening agents), polymers, ammines (e.g., AMP-95 (Angus Chemic Co., Buffalo Grove, Ill.), and $NH_3$), surface wetting agents, and/or binding agents, or other suitable additives that provide the desired characteristics in the final formulation. While the present invention is not limited to any particular mechanism of action, it is nevertheless contemplated that the superhydrophobic performance of the dried coatings results from deposition of the colloidal silica or hydrophobically-modified fumed silica in combination with the action of the one or more aforementioned additives.

In general, the preparation of stable aqueous dispersions of the superhydrophobic coatings is accomplished using a three-stage process preferentially encompassing: 1) a pre-gel stage; 2) a grind stage; and 3) a let-down stage. The General Dispersing Process and Examples provided below describe these production processes in greater detail.

General Dispersing Process

Methods of making superhydrophobic compositions comprising hydrophobically-modified fumed silicon dioxide as a class of compositions are generally known in the art. The present compositions provide the art with stable aqueous dispersions of colloidal silica or hydrophobically-modified (fumed) silicon dioxide as superhydrophobic coatings. The methods for making the stable aqueous dispersions of the present invention generally follows those methods as known in the art with the addition of certain preferred agents, as described in herein, that enhance the aqueous dispersion, stability, and coating properties of the compounds.

Step one: comprises a pre-gel formation stage wherein preferably a combination of wetting agents, clay rheology modifiers, and defoamers in water, are mixed under low to high shear conditions. Preferred compositions comprise from about 0.100% to about 5%, and more preferably from, 0.25% to 3% solids. The clay additives are dispersed in water, and the thickening effects are activated by complete deagglomeration of clay particles. The pre-gel solution is stable (i.e., 45 days or more without noticing any separation at 25 C, 50% relative humidity) and can be prepared in advance of the remaining steps.

Step two: (let down step) comprises a grinding and milling stage wherein the pre-gel solution is deagglomerated and the colloidal silica particles are dispersed in the aqueous solution. At this stage, additionally, dispersant and co-dispersant additives, rheology modifiers, defoaming agents are added to stabilize and aid the grind. In some cases, depending on the clay thickener(s) used, the grind stage is carried out after addition of pre-gel solution. The grinding process is preferably carried out using a high-shear dispersing blade for a period of from about 20 to 70 minutes. A stable colloidal silica or fumed silica dispersion of silica is obtained at the completion of the grind stage. The dispersion is stable and can be stored, or further diluted to the desired formulation viscosity to provide a finished composition.

Step three: comprises, in some embodiments, preferably adding one or more defoaming agents, and/or one or more wetting agents, and/or one or more binding agents to the pre gel of to the product of Step 2 or as described in the Examples. A final dilution of the composition with additional water under low shear mixing conditions can optionally be used at this point to provide a finished composition. Since the viscosity is being lowered, this step is preferably carried out under low shear with a propeller mixer or a Cowles blade.

Exemplary Hydrophobing Agents

The superhydrophobic coatings of the present invention comprise hydrophobically treated or untreated fumed silica or colloidal silica particles and alkoxysilane compounds functionalized with alkyl groups. It is contemplated, but the invention is not to be understood as being limited to, silica particles and functionalized alkoxysilane compounds, as part of the superhydrophobic coating system, being operative components for providing the desired level of hydrophobicity.

In preferred embodiments, the hydrophobized silica (e.g., fumed and/or colloidal) is obtained by treating silica with silane or siloxane compounds post-pyrolysis to producing methyl, dimethyl, or siloxane functionalities. Alternatively, in other embodiments, untreated silica is used as a binding agent, surface roughening agent, or as a binding surface for silane species.

Fumed silica, also known as pyrogenic silica, because it is produced in a 3000° C. electric arc, consists of microscopic droplets of amorphous silica fused into branched, chainlike, three-dimensional secondary particles which then agglomerate into tertiary particles. The resulting powders have an extremely low bulk density and high surface area. The three-dimensional structures of silica increase viscosity and enhance thixotropy of aqueous compositions. Colloidal silicas comprise suspensions of fine amorphous, nonporous, and typically spherical silica particles in a liquid phase. The surface of colloidal silica particles in contact with water are covered by siloxane bonds and silanol groups. Processes for preparing colloidal silicas are known in the art; likewise, processes are also known in the art for the hydrophobization of silicas.

Suitable hydrophobic silicas are selected from, but not limited to, silica after-treated with polydimethylsiloxane, silica after-treated with an organosilane, and silica after-treated dimethyldichlorosilane. Examples of hydrophobic silica used in the certain formulations include, but are not limited to, AMSIL™-F H22 (Brenntag, Inc., Toronto, Ontario, Canada), AEROSIL® R 202 (Evonik Industries, AG. Essen, Germany), AEROSIL® R 202, AEROSIL® R 208, AEROSIL® R 812, and AEROSIL® R 972. The compositions and formulations of the present invention generally comprise one or more one or more hydrophobic silicas from about 0.001 wt % to about 3.0 wt %, and more preferably, about 0.50 wt %.

Generally, silica is available at high purity, typically, about 99% pure and have a primary particle size range from about 5-50 nm. Silica particles are non-porous and have a surface area of 50-600 $m^2/g$.

Suitable hydrophilic silicas are selected from, but not limited to, untreated thermal silica, sodium-stabilized colloidal silica, ammonia-stabilized silica dispersions, and potassium-stabilized silica dispersion. Examples of untreated silica (hydrophilic) include, but are not limited to, LUDOX® TM-50 (WR Grace, Columbia, Md.), Cab-O-Sperse® 1020K Cabot Corp., Billerica, Mass.), Cab-O-Sperse® 1030K, AERODISP W 7520 (Evonik Industries), AEROSIL® 200 (Evonik Industries), AEROSIL® 300, and ACEMATT® TS100 (Evonik Industries). The compositions and formulations of the present invention generally comprise one or more one or more hydrophilic silicas from about 0.001 wt % to about 1.0 wt %, and more preferably, about 0.30 wt %.

Exemplary Binding Agents

The compositions and formulations of the present invention generally comprise one or more binding agents from about 0.01 wt % to about 30.0 wt %, and more preferably, from about 0.2 wt % to about 20.00 wt %, and more preferably from 1.0 wt % to about 5.0 wt %.

Binding agents generally suitable for use in embodiments of the compositions and formulations of the present invention include, but are not limited to: aqueous emulsions of alkylalkoxysilane(s), emulsions of modified polysiloxane resins, methyltrimethoxysilanes, methyltriethoxysilanes, aqueous emulsion of silicone resins, aqueous emulsions of alkylurethanes, aqueous dispersions of polymeric wax, waterborne silicone emulsions, amino-functional siloxane emulsions, and monomeric alkylalkoxysilanes. In certain embodiments, binding agents include, but are not limited to the following classes nor to the exemplary compounds mentioned therein:

(1) Silanes:
- a) aqueous emulsions of an alkylalkoxysilane, e.g., DYNASYLAN® SIVO 850, (Evonik Industries, AG, Essen, Germany);
- b) methyltrimethoxysilanes, e.g., DYNASYLAN® MTMS (Evonik);
- c) methyltriethoxysilanes, e.g., DYNASYLAN® MTES (Evonik); and
- d) monomeric alkylalkoxysilanes, e.g., Silquest™ A-137 (Momentive Performance Materials Inc., Columbus, Ohio), DYNASYLAN® OCTEO (Evonik), and DYNASYLAN® 9116;

(2) Siloxanes:
- a) emulsions of modified polysiloxane resins, e.g., TEGO® Phobe 1650 (Evonik), and Shin Etsu X-51-1302M (Shin-Etsu Chemical, Co., Ltd., Otemachi, Japan);
- b) solutions of amino functional polysiloxanes ("siloxane solutions"), e.g., TEGO® Phobe 1500 N (Evonik);
- c) aqueous emulsions of silicone resins, e.g., CoatOSil DRI (Momentive); and
- d) water-based emulsions of an amino functional siloxanes, e.g., CoatOSil 2059, (Momentive);

(3) Waxes:
- a) natural waxes, including paraffinic wax emulsions, e.g., AQUACER® 497 (BYK USA, Inc., Austin, Tex.);
- b) synthetic waxes, e.g., AQUACER® 530 (BYK USA), and AQUACER® 539;
- c) wax dispersions, e.g., LUBA print 280/F (Munzing, Suddeutsche Emulsions-Chemie GmbH, Mannheim, Germany), LUBA print 2801w, LUBA print 434/F, LUBA print 445/w, and LUBA print 942; and (4) Other Polymers:
- a) acrylic emulsions, e.g., HYCAR® 26138 (Lubrizol Corp., Wickliffe, OH) HYCAR® 26-1199, HYCAR® 26-0202, and JONCRYL® 77 (BASF Corp., Florham Park, N.J.);
- b) polymeric dispersions, e.g., WÜKOSEAL® 2800 (Munzing); and
- c) aqueous emulsions of polyurethanes, e.g., ZELAN® CA-72 (Chemours Inc., Wilmington, Del.), NEOPACK® R9036 (DSM LLC, Wilmington, Mass.), and NEOPACK® R9045.

Exemplary Dispersing, Surface Tension Reducing, and Stabilizing Additives

Exemplary rheology-modifying additives comprise, but are not limited to, urethane, phyllosilicate clay, synthetic clay thickeners, and associative thickeners for aqueous systems (e.g., solutions of polyurethane(s) such as pseudoplastic polyurethane associative thickeners; phyllosilicate clays, and/or Newtonian urethane thickeners, and/or, combinations thereof). While the present invention is not limited to any particular mechanism(s) it is contemplated that shear-dependent and thixotropic behaviors in formulations are produced and/or augmented by various singular incorporations, or combinations, of these types of thickening agents to aid in the dispersion process and as anti-settling agents among other stabilizing effects. In certain embodiments, the present formulations (i.e., the present dispersed formulations) are additionally thickened by the addition of one or more acrylic or acrylic urethane emulsions that further prevent the settling of the dispersed formulation elements.

Suitable thickening additives and/or additional aqueous polymers are selected from, but not limited to, synthetic layered silicates, synthetic layered silicates further incorporating inorganic polyphosphate peptiser, activated phyllosilicates, solutions of polyurethanes, non-ionic solutions of polyurethanes, acrylic emulsions, and acrylic urethane emulsions. Suitable exemplary, thickening additives comprise, but are not limited to, RHEOBYK®-L 1400 (BYK-Chemie, GmbH, Wesel, Germany), RHEOBYK®-H 6500VF, OPTIGEL®WX (BYK-Chemie), OPTIGEL®LX, LAPONITE®RDS, LAPONITE®-S 482, TEGO VISCOPLUS®3010 (Evonik Industries), or TEGO VISCOPLUS®3030. The compositions and formulations of the present invention generally comprise one or more thickening agents from about 0.001 wt % to about 3.0 wt %, and more preferably, from about 0.05 wt % to about 0.25 wt %.

The various dispersed aqueous compositions and formulations are further stabilized by the addition of one or more polymeric dispersant agents contemplated to provide steric stabilization. Exemplary suitable dispersant agents comprise block copolymer solutions, and acrylate copolymer emulsions, and more particularly, include, but not limited to, one or more high molecular weight block copolymers, emulsions of a structured acrylate copolymers, and solutions of copolymers with pigment-affinic groups, and the like. Exemplary dispersants include, but are not limited to, one or more DISPERBYK®-190 (BYK-Chemie), DISPERBYK'k 2010, DISPERBYK®-2080, and DISPERBYK®-2081. The compositions and formulations of the present invention generally comprise one or more dispersants/codispersants from about 0.01 wt % to about 2.0 wt %, and more preferably, from about 0.02 wt % to about 0.05 wt %.

Additionally, defoaming additives are added to retard foam creation caused by additives, silica, or shearing action of the dispersion process. Suitable defoamers generally include both silicone-free and silicone-containing polymer defoamers. Exemplary defoamers include, but are not limited to, BYK-011 (BYK-Chemie) BYK-024, and BYK-022. The compositions and formulations of the present invention generally comprise one or more defoamers from about 0.001 wt % to about 1.0 wt %, preferably, about 0.10 wt %, and more preferably, about 0.05 wt %.

In some preferred embodiments, surface tension in the aqueous carrier is moderated (e.g., reduced) by the optional addition of one or more wetting agents such as, but not limited to, tetramethyldecynediol gemini surfactants, ethoxylated acetylenic gemini surfactants, polyether siloxane copolymers, polyether-modified siloxane, and polyether-modified polysiloxane surfactants. Exemplary surface tension reducing agents and surfactants suitable for use in certain embodiments include, but are not limited to BYK® 346 (BYK-Chemie), BYK® 347, BYK®348, SURFYNOL® 104DPM (Evonik Industries), TEGO® Wet 260 (Evonik Industries), DYNOL® 604 (Evonik Industries), and DYNOL® 607. The compositions and formulations of the present invention generally comprise one or more wetting agents from about 0.001 wt % to about 1.0 wt %, and more preferably, from about 0.05 wt % to about 0.15 wt %.

Additionally, in still some other embodiments, one or more cosolvents and/or one or more co-dispersants are added to the compositions and formulations to aide film formation and stability. Suitable cosolvent or co-dispersant species include AMP-95 (Angus Chemical Co.), isopropyl alcohol, ethanol, propylene glycol methyl ether, propylene glycol n-propyl ether, dipropylene glycol n-propyl ether, dipropylene glycol methyl ether, dipropylene glycol n-butyl ether, tripropylene glycol n-butyl ether, propylene glycol n-butyl ether, 2,5,7,10-tetraoxaundecane, and 3-methoxy-3-methyl-1-butanol. Cosolvents are typically added to a primary solvent to increase the solubility of poorly soluble compounds and/or to improve film-forming characteristics; similarly, co-dispersants are added to increase the dispersion of the formulation as a whole or of one or more constituents (e.g., elements or chemical compounds) contained therein. The compositions and formulations of the present invention generally comprise one or more cosolvents from about 0.1 wt % to about 15.0 wt %, and more preferably, from about 1.00 wt % to about 10.00 wt %.

In other embodiments, the compositions further comprise one or more fast-evaporating, hydrophobic glycol ethers having high solvency and good to excellent coupling ability such as, but not limited to, PnP glycol ether, PnB glycol ether, DPnB glycol ether and/or ethylene glycol ethers (e.g., EB), and the like. The compositions and formulations of the present invention generally comprise one or more hydrophobic glycol ethers from about 1.0 wt % to about 8.0 wt %, and more preferably, from about 3.00 wt % to about 4.0 wt %.

Exemplary Aerosol Applicators and Aerosolized Treatments and Coatings

The compositions can be applied to a target substrate using any number of aerosolization technologies and devices comprising a pressurized propellant gas such as volatile organic compounds (VOCs) including, naturally occurring hydrocarbons (e.g., typically propane, n-butane and isobutene, dimethyl ether (DME), or methyl ethyl ether), carbon dioxide, nitrous oxide, or air. Suitable aerosol dispensing systems comprise self-contained air-tight pressurized containers typically cylindrically shaped having an actuator mechanism for triggering delivery of the product through a nozzle system that focuses and concentrating the product.

Preferred embodiments of the present invention employ a compressed air system to avoid the use of VOC, hydrocarbon, and carbon dioxide as propellants. Similarly, the use of hydrofluoroalkane propellants is unnecessary. Suitable piston barrier systems that use compressed air propellant are described in U.S. Pat. Nos. 9,790,019; 9,550,621; US20170327301; and EP3250475A1. In preferred embodiments, compressed air delivery devices are obtained from Airopack Technology Group AG (Waalwijk, The Netherlands). Other embodiments of the invention, are optimized for application and delivery using bag-in-can (or bag-on-valve) aerosolization systems and devices.

DETAILED DESCRIPTION OF THE INVENTION

The invention is further disclosed and illustrated in the working examples. The working examples are merely illustrative of selected specific embodiments of the invention and are not intended to be construed to limit its scope. Given the disclosure, one of ordinary skill in the art can routinely modify the process as necessary or desired.

Example 1

This Example provides Dispersion Process Formula 1, as shown in Table 1A, and the process steps incorporating this Formula to produce a dispersed silica solution called Intermediate Product 1. A quantity of Intermediate Product 1 was subsequently processed with additional agents as shown in Table 1B as per the processes described herein to produce a stable aqueously dispersed superhydrophobic composition called Exemplary Product Formulation 1.

TABLE 1A

| Dispersion Process Formula 1 | |
|---|---|
| Component | Mass (g) |
| Dynol 604 | 0.89 |
| BYK-346 | 2.68 |
| BYK-022 | 1.78 |
| Laponite RDS | 4.46 |
| Rheobyk-L 1400 | 0.89 |
| Rheobyk-H 6500VF | 0.89 |
| Disperbyk 2080 | 0.89 |
| Acematt TS100 | 5.35 |
| Joncryl 77 | 2.68 |
| DSM NeoPac R-9045 | 2.68 |
| DSM NeoPac R-9036 | 2.68 |
| DPM Glycol Ether | 0.89 |
| Isopropyl Alcohol | 50.00 |
| Water | 419.14 |

Into a 1-quart steel mixing pot, 136.24 g of water was combined with 0.21 g of BYK-022, 8.92 g of Laponite RDS, and 0.39 g of Dynol 604, the combination was mixed with an I KA μW-20 overhead stirrer affixed with a dispersing blade at a rate of 2500 rpm for 30 minutes. The resultant thickened mixture was then combined with 0.89 g of Disperbyk 2080, 5.35 g of Acematt TS100, 2.68 g of Joncryl 77, 2.68 g of DSM NeoPac R-9045, 2.68 g of DSM NeoPac-9036, 0.89 g of Rheobyk-L 1400, and 0.89 g of Rheobyk-H 6500VF. This mixture was dispersed with the overhead stirrer operated at a rate of 2500 rpm for 30 minutes until a Hegman gauge value of 7 was measured. The dispersed silica formula was let-down with 188.60 g of water while mixing with the overhead stirrer fitted with a propeller blade at 1500 rpm, and 2.68 g of BYK-346, 0.50 g of Dynol 604, 1.57 g of BYK-022, 5.00 g of DPM glycol ether, and 50 g of isopropyl alcohol were added before dilution with an additional 94.30 g of water. Intermediate Product 1 was obtained after stirring for an additional 60 minutes.

TABLE 1B

| Exemplary Product Formulation 1 | |
|---|---|
| Component | Mass (g) |
| Intermediate Product 1 | 28.04 |
| Water | 59.85 |
| DPM Glycol Ether | 0.72 |
| PnB Glycol Ether | 2.00 |
| Ispropyl Alcohol | 2.20 |
| DPnB Glycol Ether | 2.00 |
| Tego Phobe 1650 | 5.00 |
| Dynasylan MTES | 0.20 |

In a 1-quart steel mixing pot stirred at a rate of 1500 rpm with an IKA μW-20 overhead stirrer fitted with a propeller blade, 28.04 g of Intermediate Product 1 comprising a dispersed silica solution was combined with 59.85 g of water, 2.00 g of PnB glycol ether, 0.72 g of DPM glycol ether, 2.20 g of isopropyl alcohol, 2.00 g of DPnB glycol ether, 5.00 g of Tego Phobe 1650, and 0.20 g of Dynasylan MTES. The pot was stirred for 30 minutes to obtain the stable aqueously dispersed superhydrophobic composition called Exemplary Product Formulation 1.

Example 2

This Example provides Dispersion Process Formula 2, as shown in Table 2A, and the process steps incorporating this Formula to produce a dispersed silica solution called Intermediate Product 2. A quantity of Intermediate Product 2 was subsequently processed with additional agents as shown in Table 28 as per the processes described herein to produce a stable aqueously dispersed superhydrophobic composition called Exemplary Product Formulation 2.

TABLE 2A

| Dispersion Process Formula 2 | |
|---|---|
| Component | Mass (g) |
| Dynol 604 | 0.89 |
| BYK-346 | 2.68 |
| BYK-011 | 1.78 |
| Optigel WX | 2.68 |
| Rheobyk-L 1400 | 0.89 |
| Rheobyk-H 6500VF | 0.89 |
| Disperbyk 2080 | 0.89 |
| Aerosil R 812 | 5.35 |
| Joncryl 77 | 1.78 |
| DSM NeoPac R-9045 | 1.78 |
| DSM NeoPac R-9036 | 1.78 |
| DPM Glycol Ether | 5.00 |
| Isopropyl Alcohol | 50.00 |
| Water | 423.60 |

In a 1-quart steel mixing pot, 140.70 g of water was combined with 0.21 g of BYK-011, 2.68 g of Optigel WX, and 0.39 g of Dynol 604 and was mixed with an IKA μW-20 overhead stirrer affixed with a dispersing blade at a rate of 2500 rpm for 30 minutes. This thickened mixture was combined with 0.89 g of Disperbyk 2080, 5.35 g of Aerosil R 812, 1.78 g of Joncryl 77, 1.78 g of DSM NeoPac R-9045, 1.78 g DSM NeoPac R-9036, 0.89 g of Rheobyk-L 1400, and 0.89 g of Rheobyk-H 6500VF. This mixture was dispersed with the overhead stirrer operated at a rate of 2500 rpm for 30 minutes until a Hegman gauge value greater than 7 was measured. The dispersed silica formula was let down with 188.60 g of water while mixing with the overhead stirrer fitted with a propeller blade at 1500 rpm, and 2.68 g of BYK-346, 0.50 g of Dynol 604, 1.57 g of BYK-011, 5.00 g of DPM glycol ether, and 50 g of isopropyl alcohol were added before dilution with an additional 94.30 g of water. Intermediate Product 2 was obtained after stirring for an additional 60 minutes.

TABLE 2B

| Exemplary Product Formulation 2 | |
|---|---|
| Component | Mass (g) |
| Intermediate Product 2 | 28.04 |
| Water | 44.05 |
| DPM Glycol Ether | 0.72 |
| Isopropyl Alcohol | 7.20 |
| Shin-Etsu X-51-1302M | 20.00 |

In a 1-quart steel mixing pot stirred at a rate of 1500 rpm with an IKA μW-20 overhead stirrer fitted with a propeller blade, 28.04 g of Intermediate Product 2 was combined with 44.05 g of water, 0.72 g of DPM glycol ether, 7.2 g of isopropyl alcohol, and 20.00 g of Shin-Etsu X-51-1302M. The pot was stirred for 30 minutes to obtain the stable aqueously dispersed hydrophobic composition called Exemplary Product Formulation 2.

Example 3

This Example provides Dispersion Process Formula 3, as shown in Table 3A, and the process steps incorporating this Formula to produce a dispersed silica solution called Intermediate Product 3. A quantity of Intermediate Product 3 was subsequently processed with additional agents as shown in Table 3B as per the processes described herein to produce a stable aqueously dispersed superhydrophobic composition called Exemplary Product Formulation 3.

TABLE 3A

| Dispersion Process Formula 3 | |
|---|---|
| Component | Mass (g) |
| Dynol 604 | 0.89 |
| BYK-346 | 2.68 |
| BYK-011 | 1.78 |
| Optigel WX | 2.68 |
| Tego Viscoplus 3010 | 1.78 |
| Tego Viscoplus 3030 | 1.78 |
| Disperbyk 2080 | 0.89 |
| Aerosil R 812 | 5.35 |
| Joncryl 77 | 1.78 |
| DSM NeoPac R-9045 | 1.78 |
| DSM NeoPac R-9036 | 1.78 |
| DPM Glycol Ether | 5.00 |
| Isopropyl Alcohol | 50.00 |
| Water | 423.60 |

In a 1-quart steel mixing pot, 138.92 g of water was combined with 0.21 g of BYK-011, 2.68 g of Optigel WX, and 0.39 g of Dynol 604 and was mixed with an IKA μW-20 overhead stirrer affixed with a dispersing blade at a rate of 2500 rpm for 30 minutes. This thickened mixture was combined with 0.89 g of Disperbyk 2080, 5.35 g of Aerosil R 812, 1.78 g of Joncryl 77, 1.78 g of DSM NeoPac R-9045, 1.78 g of DSM NeoPac R-9036, 1.78 g of Tego Viscoplus 3010, and 1.78 g of Tego Viscoplus 3030. This mixture was dispersed with the overhead stirrer operated at a rate of 2500 rpm for 30 minutes until a Hegman gauge value of 7 was measured. The dispersed silica formula was let down with 188.60 g of water while mixing with the overhead stirrer fitted with a propeller blade at 1500 rpm, and 2.68 g of BYK-346, 0.50 g of Dynol 604, 1.57 g of BYK-011, 5.00 g of DPM glycol ether, and 50 g of isopropyl alcohol were added before dilution with an additional 94.30 g of water. Intermediate Product 3 was obtained after stirring for an additional 60 minutes.

TABLE 3B

| Exemplary Product Formulation 3 | |
|---|---|
| Component | Mass (g) |
| Intermediate Product 3 | 28.04 |
| Water | 44.05 |
| DPM Glycol Ether | 0.72 |
| Isopropyl Alcohol | 7.20 |
| Shin-Etsu X-51-1302M | 20.00 |

In a 1-quart steel mixing pot stirred at a rate of 1500 rpm with an IKA μW-20 overhead stirrer fitted with a propeller blade, 28.04 g of Intermediate Product 3 was combined with 44.05 g of water, 0.72 g of DPM glycol ether, 7.2 g of isopropyl alcohol, and 20.00 g of Shin-Etsu X-51-1302M. The pot was stirred for 30 minutes to obtain the stable aqueously dispersed superhydrophobic composition called Exemplary Product Formulation 3.

Example 4

This Example provides Dispersion Process Formula 4, as shown in Table 4A, and the process steps incorporating this Formula to produce a dispersed silica solution called Intermediate Product 4. A quantity of Intermediate Product 4 was subsequently processed with additional agents as shown in Table 4B as per the processes described herein to produce a stable aqueously dispersed superhydrophobic composition called Exemplary Product Formulation 4.

TABLE 4A

| Dispersion Process Formula 4 | |
|---|---|
| Component | Mass (g) |
| Dynol 604 | 0.89 |
| BYK-346 | 2.68 |
| BYK-022 | 1.78 |
| Laponite RDS | 8.92 |
| Joncryl 77 | 2.68 |
| Tego Viscoplus 3010 | 1.78 |
| Tego Viscoplus 3030 | 1.78 |
| Disperbyk 190 | 0.36 |
| Aerosil R 208 | 5.35 |
| DPM Glycol Ether | 5.00 |
| Isopropyl Alcohol | 50.00 |
| Water | 418.79 |

In a 1-quart steel mixing pot, 134.99 g of water was combined with 0.21 g of BYK-022, 8.92 g of Laponite RDS, and 0.39 g of Dynol 604 and was mixed with an IKA RW-20 overhead stirrer affixed with a dispersing blade at a rate of 2500 rpm for 30 minutes. This thickened mixture was combined with 0.36 g of Disperbyk 190, 5.35 g of Acematt TS100, 2.68 g of Joncryl 77, 2.68 g of DSM NeoPac R-9045, 2.68 g of DSM NeoPac-9036, 1.78 g of Tego Viscoplus 3010, and 1.78 g of Tego Viscoplus 3030. This mixture was dispersed with the overhead stirrer operated at a rate of 2500 rpm for 30 minutes. This dispersion was then passed through a 1000 mL EMI Laboratory Mini Mill. The dispersed silica formula was let down with 188.60 g water while mixing with the overhead stirrer fitted with a propeller blade at 1500 rpm, and 2.68 g of BYK-346, 0.50 g of Dynol 604, 1.57 g of BYK-022, 5.00 g of DPM glycol ether, and 50 g of isopropyl alcohol were added before dilution with an additional 94.30 g of water. Intermediate Product 4 was obtained after stirring for an additional 60 minutes.

TABLE 4B

| Exemplary Product Formulation 4 | |
|---|---|
| Component | Mass (g) |
| Intermediate Product 4 | 28.037 |
| Water | 61.847 |
| PnB Glycol Ether | 2.000 |
| DPM Glycol Ether | 0.720 |
| Isopropyl Alcohol | 2.196 |
| Tego Phobe 1650 | 5.000 |
| Dynasylan MTES | 0.200 |

In a 1-quart steel mixing pot stirred at a rate of 1500 rpm with an IKA RW-20 overhead stirrer fitted with a propeller blade, 28.037 g of the dispersed silica solution was combined with 59.85 g 61.847 of water, 2.00 g of PnB glycol ether, 0.72 g of DPM glycol ether, 2.20 g of isopropyl alcohol, 2.00 g of DPnB glycol ether, 5.00 g of Tego Phobe 1650, and 0.20 g of Dynasylan MTES. The pot was stirred for 30 minutes to obtain the stable aqueously dispersed superhydrophobic composition called Exemplary Product Formulation 4.

Example 5

This Exemplary embodiment describes one Product Formulation suited to treating fabrics and/or textiles to make them hydrophobic or superhydrophobic. Exemplary Product Formulation 5 is prepared using the pre-gel forming, let-down, and final formulation methods described herein, and more specifically, as described in the preceding Examples. The preferred formula is set forth in Table 5 below.

While the present invention is not limited to any particular mechanisms of action, and indeed, the invention is not so limited, it is contemplated that in preferred embodiments, such as that described in this Example, that the four aqueous dispersion components in the composition work together synergistically to provide complementary but different stain or water-resistant functionalities. In this embodiment, the components favorably comprise a reactive alkyl-urethane, a reactive silicone, a non-reactive silicone elastomer, and a nonreactive polymeric wax dispersion, wherein, the reactive alkyl-urethane (e.g., ZELAN CA-72, Chemours Inc., Wilmington, Del.), creates durability and wash resistance. The reactive silicone, COATOSIL® 2059 (Momentive Performance Materials Inc., Columbus, Ohio), also improves durability, penetrates textile and fabric fibers to reduce uptake of stains, and offers fast-forming water repellency. COATOSIL® DRI is a silicone elastomer that forms a very thin coating on fibers to prevent penetration of stains into the substrate. Polymer wax dispersions, such as, WÜKO-SEAL® 2800, improves the oleophobicity and fast-forming water repellency of the Exemplary Product Formulation 5.

TABLE 5

Exemplary Product Formulation 5

| COMPONENT | RANGE UPPER LIMIT | RANGE LOWER LIMIT | RANGE A +/−100% OF OPTIMAL | RANGE B +/−75% OF OPTIMAL | RANGE C +/−50% OF OPTIMAL | RANGE D +/−25% OF OPTIMAL | OPTIMAL |
|---|---|---|---|---|---|---|---|
| Dynol 604 | 1.000% | 0.001% | 0.0280%-0.0010% | 0.0245%-0.0035% | 0.0210%-0.0070% | 0.0175%-0.0105% | 0.014% |
| BYK-022 | 1.000% | 0.010% | 0.9600%-0.0100% | 0.8400%-0.1200% | 0.7200%-0.2400% | 0.6000%-0.3600% | 0.480% |
| Optigel LX | 1.000% | 0.010% | 0.5000%-0.0100% | 0.4375%-0.0625% | 0.3750%-0.1250% | 0.3125%-0.1875% | 0.250% |
| Disperbyk 190 | 1.000% | 0.010% | 0.0400%-0.0100% | 0.0350%-0.0100% | 0.0300%-0.0100% | 0.0250%-0.0150% | 0.020% |
| Aerosil R 208 | 2.000% | 0.010% | 1.0000%-0.0100% | 0.8750%-0.1250% | 0.7500%-0.2500% | 0.6250%-0.3750% | 0.500% |
| Rheobyk-L 1400 VF | 2.000% | 0.010% | 0.3900%-0.0100% | 0.3413%-0.0488% | 0.2925%-0.0975% | 0.2438%-0.1463% | 0.195% |
| Rheobyk-H 6500 VF | 5.000% | 0.250% | 0.2500%-0.2500% | 0.2500%-0.2500% | 0.2500%-0.2500% | 0.2500%-0.2500% | 0.027% |
| BYK-011 | 5.000% | 0.250% | 0.9600%-0.2500% | 0.8400%-0.2500% | 0.7200%-0.2500% | 0.6000%-0.3600% | 0.480% |
| PnB Glycol Ether | 5.000% | 0.250% | 5.0000%-0.2500% | 5.0000%-0.7500% | 4.5000%-1.5000% | 3.7500%-2.2500% | 3.000% |
| DPM Glycol Ether | 5.000% | 1.000% | 5.0000%-1.0000% | 5.0000%-1.2500% | 5.0000%-2.5000% | 5.0000%-3.7500% | 5.000% |
| Deionized Water | 10.000% | 1.000% | 1.0000%-1.0000% | 1.0000%-1.0000% | 1.0000%-1.0000% | 1.0000%-1.0000% | 0.000% |
| Zelan CA-72 | 10.000% | 1.000% | 10.0000%-1.0000% | 8.7500%-1.2500% | 7.5000%-2.5000% | 6.2500%-3.7500% | 5.000% |
| CoatOSil 2059 | 10.000% | 1.000% | 7.0000%-1.0000% | 6.1250%-1.0000% | 5.2500%-1.7500% | 4.3750%-2.6250% | 3.500% |
| CoatOSil DRI | 10.000% | 1.000% | 3.4220%-1.0000% | 2.9943%-1.0000% | 2.5665%-1.0000% | 2.1388%-1.2833% | 1.711% |
| Wükoseal 2800 | 10.000% | 1.000% | 3.4220%-1.0000% | 2.9943%-1.0000% | 2.5665%-1.0000% | 2.1388%-1.2833% | 1.711% |

Example 6

Process Method

This Example provides an exemplary formulation process, in particular, the method used to create Exemplary Product Formulation 6, as is shown in Table 6. This process was also used to create Exemplary Product Formulations 7 and 8, as Shown in Tables 7 and 8 below. In a 1-quart steel mixing pot stirred at a rate of 1500 rpm with an IKA RW-20 overhead stirrer fitted with a propeller blade, 327.98 g deionized water was combined with 0.60 g RHEOBYK®-L 1400VF, 0.60 g of RHEOBYK®-H 6500VF, 6.00 g LUDOX™-50, and 0.06 g DYNOL® 604. This mixture was stirred at 1500 rpm for 30 minutes. The stirring speed was reduced to 600 rpm, and 12.00 g DPM glycol ether, 18.00 g PnP glycol ether, 12.00 g PnB glycol ether were added and mixed for 10 minutes. Further, 12.90 g WÜKOSEAL® 2800, 13.80 g COATOSIL® DRI, and COATOSIL® 2059 were added and stirred at 600 rpm for 5 minutes to create Intermediate Product 6. Separately, 40.50 g ZELAN® CA-72 was added to 140.56 g deionized water and stirred at 500 rpm with a magnetic stir plate and bar for 5 minutes. This blend was added to Intermediate Product 6 and stirred for 60 minutes at 400 rpm to create Exemplary Product Formulation 6.

TABLE 6

Exemplary Product Formulation 6

| COMPONENT | RANGE UPPER LIMIT | RANGE LOWER LIMIT | RANGE A +/−100% OF OPTIMAL | RANGE B +/−75% OF OPTIMAL | RANGE C +/−50% OF OPTIMAL | RANGE D +/−25% OF OPTIMAL | OPTIMAL |
|---|---|---|---|---|---|---|---|
| Dynol 604 | 1.000% | 0.001% | 0.0010%-0.0200% | 0.0025%-0.0175% | 0.0050%-0.0150% | 0.0075%-0.0125% | 0.010% |
| Ludox TM-50 | 1.000% | 0.010% | 0.0100%-1.0000% | 0.2500%-1.0000% | 0.5000%-1.0000% | 0.7500%-1.0000% | 1.000% |
| Rheobyk-L 1400 | 1.000% | 0.010% | 0.0100%-0.2000% | 0.0250%-0.1750% | 0.0500%-0.1500% | 0.0750%-0.1250% | 0.100% |
| Rheobyk-H 6500VF | 1.000% | 0.010% | 0.0100%-0.2000% | 0.0250%-0.1750% | 0.0500%-0.1500% | 0.0750%-0.1250% | 0.100% |
| BYK-011 | 2.000% | 0.010% | 0.0100%-0.0100% | 0.0100%-0.0100% | 0.0100%-0.0100% | 0.0100%-0.0100% | 0.000% |
| BYK-024 | 2.000% | 0.010% | 0.0100%-0.0100% | 0.0100%-0.0100% | 0.0100%-0.0100% | 0.0100%-0.0100% | 0.000% |
| DPM Glycol Ether | 5.000% | 0.250% | 0.2500%-4.0000% | 0.5000%-3.5000% | 1.0000%-3.0000% | 1.5000%-2.5000% | 2.000% |
| PnP Glycol Ether | 5.000% | 0.250% | 0.2500%-5.0000% | 0.7500%-5.0000% | 1.5000%-4.5000% | 2.2500%-3.7500% | 3.000% |
| PnB Glycol Ether | 5.000% | 0.250% | 0.2500%-4.0000% | 0.5000%-3.5000% | 1.0000%-3.0000% | 1.5000%-2.5000% | 2.000% |
| Tego Phobe 1500 N | 5.000% | 1.000% | 1.0000%-1.0000% | 1.0000%-1.0000% | 1.0000%-1.0000% | 1.0000%-1.0000% | 0.000% |
| Zelan CA-72 | 10.000% | 1.000% | 1.0000%-10.0000% | 1.6875%-10.0000% | 3.3750%-10.0000% | 5.0625%-8.4375% | 6.750% |
| CoatOSil DRI | 10.000% | 1.000% | 1.0000%-4.6000% | 1.0000%-4.0250% | 1.1500%-3.4500% | 1.7250%-2.8750% | 2.300% |
| CoatOSil 2059 | 10.000% | 1.000% | 1.0000%-5.0000% | 1.0000%-4.3750% | 1.2500%-3.7500% | 1.8750%-3.1250% | 2.500% |
| Wükoseal 2800 | 10.000% | 1.000% | 1.0000%-4.3000% | 1.0000%-3.7625% | 1.0750%-3.2250% | 1.6125%-2.6875% | 2.150% |
| Silquest A-137 | 10.000% | 1.000% | 1.0000%-1.0000% | 1.0000%-1.0000% | 1.0000%-1.0000% | 1.0000%-1.0000% | 0.000% |
| Deinonized Water | 59.000% | 94.000% | 93.1990%-59.6600% | 91.2400%-62.4500% | 87.0250%-65.7400% | 81.5475%-70.8425% | 78.090% |

40

TABLE 7

Exemplary Product Formulation 7

| COMPONENT | RANGE UPPER LIMIT | RANGE LOWER LIMIT | RANGE A +/−100% OF OPTIMAL | RANGE B +/−75% OF OPTIMAL | RANGE C +/−50% OF OPTIMAL | RANGE D +/−25% OF OPTIMAL | OPTIMAL |
|---|---|---|---|---|---|---|---|
| Dynol 604 | 1.000% | 0.001% | 0.0200%-0.0010% | 0.0175%-0.0025% | 0.0150%-0.0050% | 0.0125%-0.0075% | 0.010% |
| Ludox TM-50 | 1.000% | 0.010% | 1.0000%-0.0100% | 1.0000%-0.2500% | 1.0000%-0.5000% | 1.0000%-0.7500% | 1.000% |
| Rheobyk-L 1400 | 1.000% | 0.010% | 0.2000%-0.0100% | 0.1750%-0.0250% | 0.1500%-0.0500% | 0.1250%-0.0750% | 0.100% |
| Rheobyk-H 6500VF | 1.000% | 0.010% | 0.2000%-0.0100% | 0.1750%-0.0250% | 0.1500%-0.0500% | 0.1250%-0.0750% | 0.100% |
| BYK-011 | 2.000% | 0.010% | 0.0100%-0.0100% | 0.0100%-0.0100% | 0.0100%-0.0100% | 0.0100%-0.0100% | 0.000% |
| BYK-024 | 2.000% | 0.010% | 0.0100%-0.0100% | 0.0100%-0.0100% | 0.0100%-0.0100% | 0.0100%-0.0100% | 0.000% |
| DPM Glycol Ether | 5.000% | 0.250% | 4.0000%-0.2500% | 3.5000%-0.5000% | 3.0000%-1.0000% | 2.5000%-1.5000% | 2.000% |
| PnP Glycol Ether | 5.000% | 0.250% | 5.0000%-0.2500% | 5.0000%-0.7500% | 4.5000%-1.5000% | 3.7500%-2.2500% | 3.000% |
| PnB Glycol Ether | 5.000% | 0.250% | 4.0000%-0.2500% | 3.5000%-0.5000% | 3.0000%-1.0000% | 2.5000%-1.5000% | 2.000% |
| Tego Phobe 1500 N | 5.000% | 1.000% | 1.0000%-1.0000% | 1.0000%-1.0000% | 1.0000%-1.0000% | 1.0000%-1.0000% | 0.000% |
| Zelan CA-72 | 10.000% | 1.000% | 10.0000%-1.0000% | 10.0000%-1.6875% | 10.0000%-3.3750% | 8.4375%-5.0625% | 6.750% |

TABLE 7-continued

| Exemplary Product Formulation 7 | | | | | | | |
|---|---|---|---|---|---|---|---|
| COMPONENT | RANGE UPPER LIMIT | RANGE LOWER LIMIT | RANGE A +/−100% OF OPTIMAL | RANGE B +/−75% OF OPTIMAL | RANGE C +/−50% OF OPTIMAL | RANGE D +/−25% OF OPTIMAL | OPTIMAL |
| CoatOSil DRI | 10.000% | 1.000% | 4.6000%-1.0000% | 4.0250%-1.0000% | 3.4500%-1.1500% | 2.8750%-1.7250% | 2.300% |
| CoatOSil 2059 | 10.000% | 1.000% | 5.0000%-1.0000% | 4.3750%-1.0000% | 3.7500%-1.2500% | 3.1250%-1.8750% | 2.500% |
| Wükoseal 2800 | 10.000% | 1.000% | 4.3000%-1.0000% | 3.7625%-1.0000% | 3.2250%-1.0750% | 2.6875%-1.6125% | 2.150% |
| Silquest A-137 | 10.000% | 1.000% | 10.0000%-1.0000% | 8.7500%-1.2500% | 7.5000%-2.5000% | 6.2500%-3.7500% | 5.000% |
| Deinonized Water | 59.000% | 94.000% | 50.6600%-93.1990% | 54.7000%-90.9900% | 59.2400%-85.5250% | 65.5925%-78.7975% | 73.090% |

TABLE 8

| Exemplary Product Formulation 8 | | | | | | | |
|---|---|---|---|---|---|---|---|
| COMPONENT | RANGE UPPER LIMIT | RANGE LOWER UMIT | RANGE A +/−100% OF OPTIMAL | RANGE B +/−75% OF OPTIMAL | RANGE C +/−50% OF OPTIMAL | RANGE D +/−25% OF OPTIMAL | OPTIMAL |
| Dynol 604 | 1.000% | 0.001% | 0.0200%-0.0010% | 0.0175%-0.0025% | 0.0150%-0.0050% | 0.0125%-0.0075% | 0.010% |
| Ludox TM-50 | 1.000% | 0.010% | 1.0000%-0.0100% | 1.0000%-0.2500% | 1.0000%-0.5000% | 1.0000%-0.7500% | 1.000% |
| Rheobyk-L 1400 | 1.000% | 0.010% | 0.2000%-0.0100% | 0.1750%-0.0250% | 0.1500%-0.0500% | 0.1250%-0.0750% | 0.100% |
| Rheobyk-H 6500VF | 1.000% | 0.010% | 0.2000%-0.0100% | 0.1750%-0.0250% | 0.1500%-0.0500% | 0.1250%-0.0750% | 0.100% |
| BYK-011 | 2.000% | 0.010% | 0.3000%-0.0100% | 0.2625%-0.0375% | 0.2250%-0.0750% | 0.1875%-0.1125% | 0.150% |
| BYK-024 | 2.000% | 0.010% | 0.3000%-0.0100% | 0.2625%-0.0375% | 0.2250%-0.0750% | 0.1875%-0.1125% | 0.150% |
| DPM Glycol Ether | 5.000% | 0.250% | 4.0000%-0.2500% | 3.5000%-0.5000% | 3.0000%-1.0000% | 2.5000%-1.5000% | 2.000% |
| PnP Glycol Ether | 5.000% | 0.250% | 5.0000%-0.2500% | 5.0000%-0.7500% | 4.5000%-1.5000% | 3.7500%-2.2500% | 3.000% |
| PnB Glycol Ether | 5.000% | 0.250% | 2.0000%-0.2500% | 1.7500%-0.2500% | 1.5000%-0.5000% | 1.2500%-0.7500% | 1.000% |
| Tego Phobe 1500 N | 5.000% | 1.000% | 4.0000%-1.0000% | 3.5000%-1.0000% | 3.0000%-1.0000% | 2.5000%-1.5000% | 2.000% |
| Zelan CA-72 | 10.000% | 1.000% | 1.0000%-1.0000% | 1.0000%-1.0000% | 1.0000%-1.0000% | 1.0000%-1.0000% | 0.000% |
| CoatOSil DRI | 10.000% | 1.000% | 4.6000%-1.0000% | 4.0250%-1.0000% | 3.4500%-1.1500% | 2.8750%-1.7250% | 2.300% |
| CoatOSil 2059 | 10.000% | 1.000% | 5.0000%-1.0000% | 4.3750%-1.0000% | 3.7500%-1.2500% | 3.1250%-1.8750% | 2.500% |
| Wükoseal 2800 | 10.000% | 1.000% | 4.3000%-1.0000% | 3.7625%-1.0000% | 3.2250%-1.0750% | 2.6875%-1.6125% | 2.150% |
| Silquest A-137 | 10.000% | 1.000% | 10.0000%-1.0000% | 8.7500%-1.2500% | 7.5000%-2.5000% | 6.2500%-3.7500% | 5.000% |
| Deinonized Water | 59.000% | 94.000% | 58.0800%-93.1990% | 62.4450%-91.8725% | 67.3100%-88.2700% | 72.4250%-82.9050% | 78.540% |

Example 7

Hydrophobicity Testing

The Exemplary Product Formulations from the preceding Examples were evaluated in an array of quantitative and qualitative tests. Formula stability, water beading, and fabric residue deposited during application were measured qualitatively, while contact angle was measured quantitatively for initial contact angle for a 10 μL droplet of deionized water, and a contact angle after 30 s resting time on the substrate. Four exemplary fabrics were chosen for evaluation of each formulation: a 100% cotton fabric, a 68% polyester/32% cotton blend, a 55% linen/45% rayon blend, and an 86% polyester/14% rayon blend. All fabrics were purchased from Jo-ANN Fabrics and Crafts. (JO-ANN Fabrics and Crafts, Inc., Hudson, OH). Table 9 describes the rubric created for qualitative evaluation. Qualitative evaluations for stability were rated as stable or settled. Otherwise, evaluations were rated on a scale of poor, fair, good, and excellent. Contact angles were measured using a Canon EOS 77D camera and EF-560 mm f/2.8 macro lens. Table 10 lists all qualitative results for each example, as well as the average initial and final contact angles for each example across the four exemplary fabric substrates. FIGS. 2-7 show the results for initial contact angle, contact angles after 30 s, the total decrease in contact angle over 30 s, and the average contact angle and average contact angle decrease over 30 s. It is shown that Exemplary Product Formulations both had higher contact angles initially, with Exemplary Product Formulation 8 being superhydrophobic on most substrates and higher resiliency against a decrease in contact angle over-exposure time. Additionally, Exemplary Product Formulations 6 and 8 show excellent performance and consistently high contact angle on all exemplary fabrics.

TABLE 9

| Qualitative Evaluation Rubric | | | | |
|---|---|---|---|---|
| Rating | Poor | Fair | Good | Excellent |
| Residue | Performance is worse or shows no improvement versus untreated | Appearance or feel is noticeably changed | Appearance or feel is slightly changed | No look or feel change |
| Water Beading | Performance is worse or shows no improvement versus untreated | Water beading improves slightly vs. untreated on some fabrics | Water readily rolls off fabric, leaves degree of wetness over time. Some inconsistency across different fabrics. | Water readily rolls off fabric, does not soak in over time, and performs similarly on all fabrics |

TABLE 10

| Testing Summary for Exemplary Product Formulations | | | | | | | | | |
|---|---|---|---|---|---|---|---|---|---|
| | Test | F-1* | F-2 | F-3 | F-4 | F-5 | F-6 | F-7 | F-8 |
| Formula Stability | Silica Grind base | Stable | Stable | Stable | Stable | Stable | Stable | Stable | Stable |
| | Final Formula | Stable | Settled Overnight | Settled Overnight | Stable | Stable | | | |
| Fabric Residue | Appearance | Excellent | Good | Poor | Excellent | Poor | Excellent | Excellent | Excellent |
| | Stiffness | Excellent | Fair | Poor | Excellent | Poor | Excellent | Excellent | Excellent |
| Water Beading | 12-hour | Fair | Fair | Poor | Fair | Fair | Good | Fair | Good |
| | 24-hour | Fair | Fair | Fair | Fair | Excellent | Excellent | Excellent | Excellent |
| Average Contact Angle | Initial | 131.34° ± 8.16° | 137.69° ± 4.09° | 97.66° ± 32.72° | 132.82° ± 4.70° | 133.02° ± 3.40° | 138.59° ± 4.63° | 143.70° ± 4.96° | 149.09° ± 8.00° |
| | After 30 s | 67.40° ± 39.20° | 102.61° ± 34.61° | 86.46° ± 31.53° | 86.86° ± 30.61° | 129.56° ± 5.14° | 138.54° ± 5.43° | 139.75° ± 3.31° | 149.64° ± 7.81° |

*F-X refers to the number of the Formulation as used herein

Modifications and variations of the present invention will be obvious to those skilled in the art from the foregoing detailed description of the invention. Such modifications and variations are intended to come within the scope of the appended claims.

INCORPORATION BY REFERENCE

All U.S. and foreign Patent Publications, Patent Applications, and Patents are hereby expressly and specifically incorporated by reference in their entireties.

What is claimed is:

1. A composition, the composition comprising:
an aqueously dispersed superhydrophobic composition;
the superhydrophobic composition comprising:
an alkoxysilane functionalized with an alkyl group;
a binding agent and
a hydrophilic silica.

2. The composition of claim 1 further comprising a rheology-modifying additive.

3. The composition of claim 2 wherein the rheology-modifying additive comprises urethane.

4. The composition of claim 1 further comprising a polymeric dispersant agent.

5. The composition of claim 4 wherein the polymeric dispersant agent comprises a block copolymer.

6. The composition of claim 1 further comprising a defoaming additive.

7. The composition of claim 6 wherein the defoaming additive comprises a polymer defoamer.

8. The composition of claim 1 further comprising a cosolvent.

9. The composition of claim 8 wherein the cosolvent comprises isopropyl alcohol.

10. The composition of claim 1 further comprising a wetting agent.

11. The composition of claim 10 wherein the wetting agent comprises a tetramethyldecynediol gemini surfactant.

12. The composition of claim 10 wherein the wetting agent comprises a polyether siloxane copolymer.

13. The composition of claim 1 wherein the binding agent comprises a methyltrimethoxysilane.

14. The composition of claim 1 wherein the binding agent comprises an emulsion of a modified polysiloxane resin.

15. The composition of claim 1 further comprising a glycol ether.

16. The composition of claim 15 wherein the glycol ether is hydrophobic.

* * * * *